US006241410B1

(12) United States Patent
Hager

(10) Patent No.: US 6,241,410 B1
(45) Date of Patent: Jun. 5, 2001

(54) CHALK HOLDING DEVICE

(76) Inventor: Michael Eugene Hager, 740 Burguss Rd., High Point, NC (US) 27265

( * ) Notice: Subject to any disclaimer, the term of this patent is extended or adjusted under 35 U.S.C. 154(b) by 0 days.

(21) Appl. No.: 09/417,392

(22) Filed: Oct. 13, 1999

(51) Int. Cl.[7] ..... B43K 23/016
(52) U.S. Cl. ..... 401/89; 401/92
(58) Field of Search ..... 401/88, 89, 90, 401/92, 98, 140

(56) References Cited

U.S. PATENT DOCUMENTS

| | | | | |
|---|---|---|---|---|
| 959,531 | * | 5/1910 | Hollenberger | 401/89 |
| 1,329,420 | * | 2/1920 | Lynch | 401/89 |
| 2,134,863 | * | 11/1938 | Dvorak | 401/92 |
| 2,687,116 | * | 8/1954 | Sheets | 401/93 |
| 4,202,108 | * | 5/1980 | Adams, Jr. et al. | 33/189 |
| 4,238,163 | * | 12/1980 | Hung | 401/89 |
| 4,742,596 | * | 5/1988 | Altman | 401/88 |
| 5,931,592 | * | 8/1999 | Timberlake | 401/88 |

FOREIGN PATENT DOCUMENTS

| | | | | |
|---|---|---|---|---|
| 831655 | * | 2/1952 | (DE) | 401/88 |
| 437062 | * | 12/1912 | (FR) | 401/88 |
| 1-202500 | * | 8/1989 | (JP) | 401/88 |

* cited by examiner

*Primary Examiner*—Charles R. Eloshway

(57) ABSTRACT

A chalk holding device (10) for use with sidewalk chalk and the like. The inventive device includes an elongate tube (20) having an attachment grip (26) for holding a piece of sidewalk chalk at the lower end of the tube. The upper end of said tube has a removable closure (24) for inserting extra pieces of chalk into said tube for storage. The holding device (10) is of a predetermined length whereby the human user may write or draw on a ground-level surface from a generally upright position.

12 Claims, 4 Drawing Sheets

CHALK HOLDING DEVICE

CROSS-REFERENCES TO RELATED APPLICATIONS

Not applicable.

BACKGROUND

1. Field of Invention

The present invention relates to a holder for writing or drawing materials such as chalk, crayons, or the like.

2. Description of Prior Art

Large pieces of chalk commonly known as sidewalk chalk, or sidewalk chalk sticks, have been marketed for many years primarily for use by children for writing and drawing on hard surfaces, typically sidewalks, paved driveways or other paved surfaces. The human user, even small children, must assume a bent, squatting, or sitting position to mark on ground-level surfaces with this chalk. Note that references to ground level surfaces in this document are meant to convey any surface upon which a human may stand, and may include floors or elevated surfaces.

Sidewalk chalk is commonly available in cylindrical shape, usually tapered, and in a variety of colors. It is also available in a wide variety of shapes. Characteristically, sidewalk chalk differs in size from that of other conventional chalk such as is used for writing on classroom blackboards. Typical sidewalk chalk sticks are approximately one inch in diameter at one end, tapered to ⅞ inch at the other end and are approximately 4 inches in length. The smaller conventional chalk is inherently more prone to accidental breakage. Some of the prior art cited below is inspired by the need to prevent breakage in the smaller chalk.

Various types of chalk holding devices have been disclosed in the prior art. Some are designed for use in a conventional manner by grasping the device in one hand held close to the writing surface. Examples include U.S. Pat. Nos. 2,205,907; 5,048,989; 4,468,146; 2,181,202; 5,779,381; 3,603,693; 332,157; and 354,311. U.S. Pat. No. 389,517 discloses a hand held apparatus that holds three pieces of chalk parallel to one another for drawing lines in triplicate. Other specialized chalk holding devices are disclosed for use in marking livestock as disclosed in U.S. Pat. No. 332,157.

While these devices fulfill their respective, particular objectives and requirements, the aforementioned patents do not disclose a new chalk holding device. The inventive device includes a generally cylindrical shell of a length and diameter capable of holding large sticks of chalk commonly referred to as sidewalk chalk. Furthermore, the new device permits a human to grasp this device with either or both hands and manipulate the chalk on a ground level surface from a generally upright position.

Among the prior art, three devices are known that permit marking with chalk on or near a ground level surface from a generally upright position. U.S. Pat. No. 5,895,072 discloses an attachment for securing chalk to in-line roller skates, an obviously restricted use. A tire marking device comprising a handle and collet extending at an angle away from the longitudinal axis of the handle is disclosed in U.S. Pat. No. 2,687,116. A device with an elongated shaft and a lower curved portion for marking automobile tires is disclosed in U.S. Pat. No. 5,931,592. The tire marking devices are designed for marking surfaces roughly parallel to the upright human user. These devices do not lend themselves to easy use on a surface generally perpendicular to the upright human.

Another aspect of the inventive device is the inclusion of means for storing extra pieces of chalk stacked in series end to end. There are no known examples in the prior art of writing instruments designed for sidewalk chalk that also provide for storing extra pieces of chalk.

SUMMARY

In accordance with the present invention a writing implement comprising a cylindrical tube generally about 1 to 5 feet in length, a grip having an aperture, a spacer and provision for storage of extra pieces of chalk.

Objects and Advantages

Accordingly, several objects and advantages of my invention are the means to allow a human to write, draw, or make marks on a ground level surface with chalk sticks or other marking implements from a generally upright and comfortable position. Furthermore, an extended reach is provided for the human user which can be used to facilitate marking on a surface removed from the user in any direction.

Consequently the user of this invention is allowed coverage of a broad writing, recreational, or artistic design easier and quicker then can be done without the device. A further benefit is the broadened appeal of sidewalk chalk for use with large scale markings such as a quick layout of boundaries for hard court basketball, street hockey and other recreational activities. Along with the new uses readily apparent is the widened consumer appeal. Specifically, older children and adults will be able to use sidewalk chalk more readily. The invention also allows for use while minmizing direct contact with a dusty or messy marking implement.

An advantage of my invention is the flexibility provided in use to change the effective reach of the writing implement simply by grasping the holder in a different position anywhere along the longitudinal axis.

A further advantage of my invention is the provision for storage of extra chalk pieces that is transportable with the writing instrument. The storage compartment size is also adjustable by simply repositioning the spacer inside the shaft of the chalk holder.

This invention also contemplates the use of alternative writing implements such as crayon, charcoal, felt or other composition markers and the like. Other uses of this invention include marking on any surface that an extended reach is required, such as a ceiling or object beyond arms' length of the human user. The holder is simple to manufacture from cheap and plentiful raw materials. It is of durable construction and intended for repetitive use.

Further objects and advantages of my invention will become apparent from a consideration of the drawings and ensuing description.

DRAWING FIGURES

REFERENCE NUMERALS IN DRAWINGS

Figure 1:
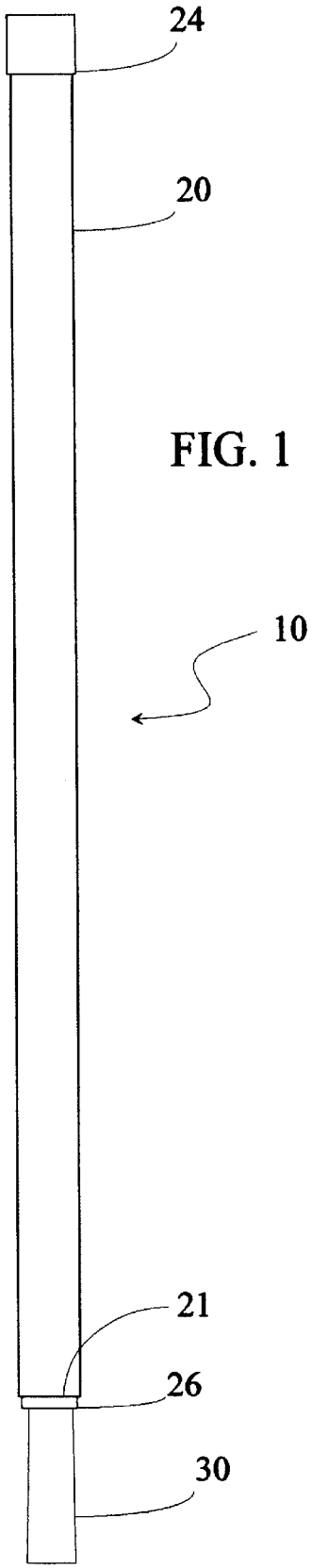
FIG. 1 shows a view of the overall invention.

10 holder
20 tube
21 bore

22 spacer
24 closure
26 grip
26B grip with partial shaft
26C grip with tapered shaft
26D grip with collet
26E grip with outside flanges
27 aperture of grip
28 collet
28A tab
29 flange
30 chalk in grip
32 extra chalk in storage
34 storage compartment
35 tapered shaft
36 inside wall of grip

DESCRIPTION

FIGS. 1 to 5A—Preferred Embodiment

Referring now to the drawings, and particularly to FIGS. 1 through 4 thereof, a new chalk holding device embodying the principles and concepts of the present invention and generally designated by the reference numeral 10 will be described.

Figure 2:
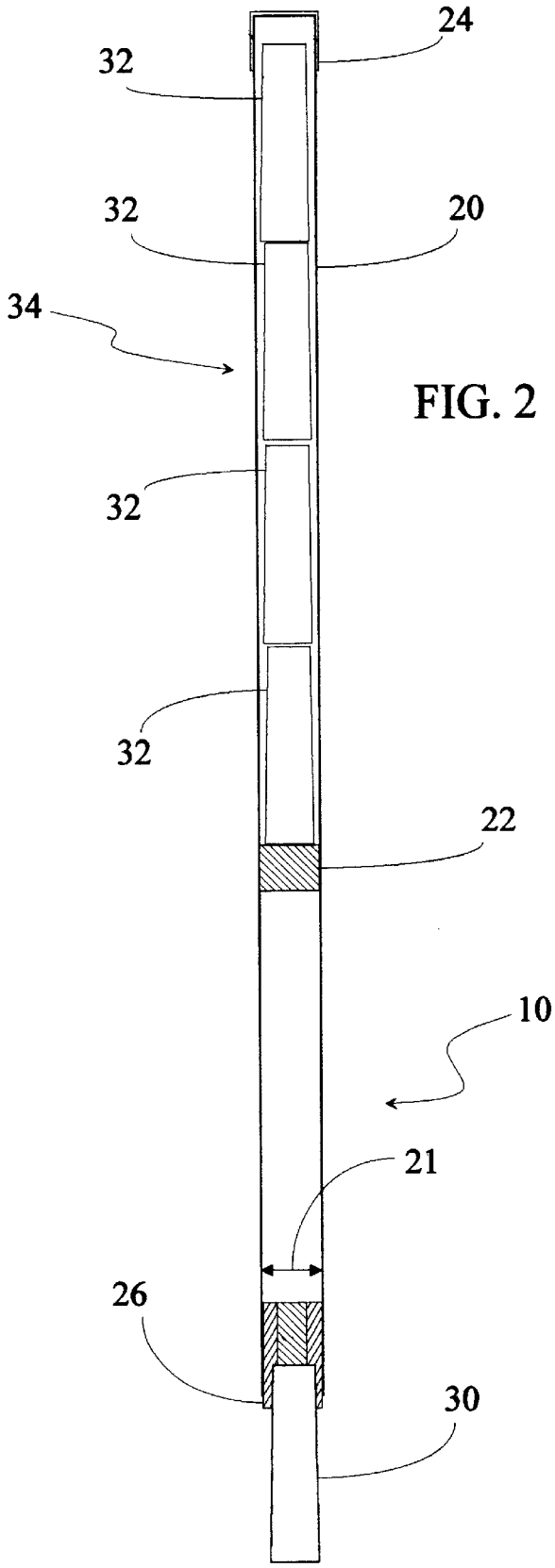
FIG. 2 shows a full section perspective of the invention.
Figure 3:
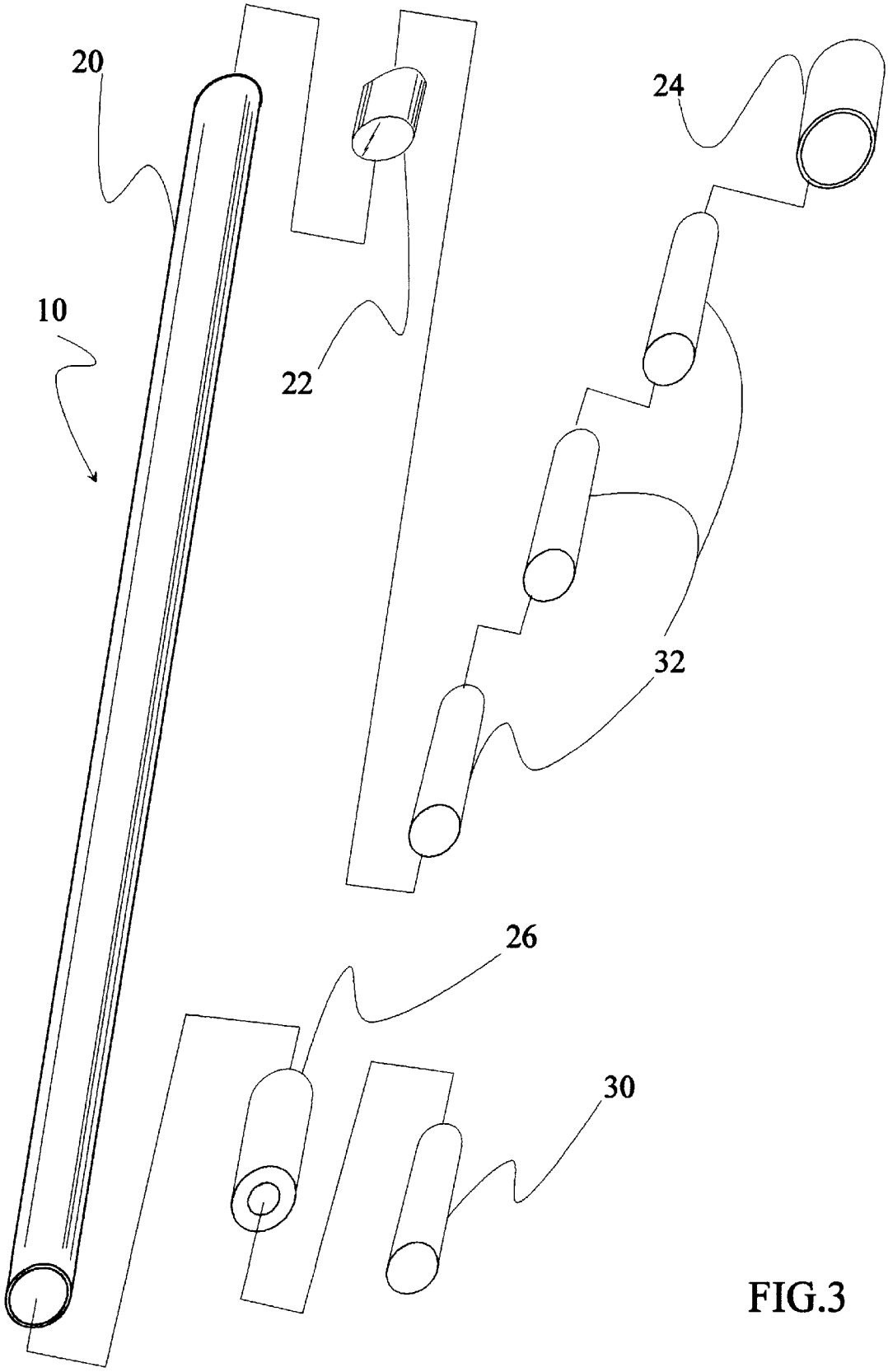
FIG. 3 shows a perspective of unassembled parts of the invention.

As illustrated in FIGS. 1 through 3 thereof, there is shown a holder 10 in the form of a cylindrical casing, shaft, or tube 20 that surrounds a chuck, collar, or grip 26, said grip holding a stick of writing material 30, such as chalk, crayon, or the like at the lower end of said holder.

Figure 4:
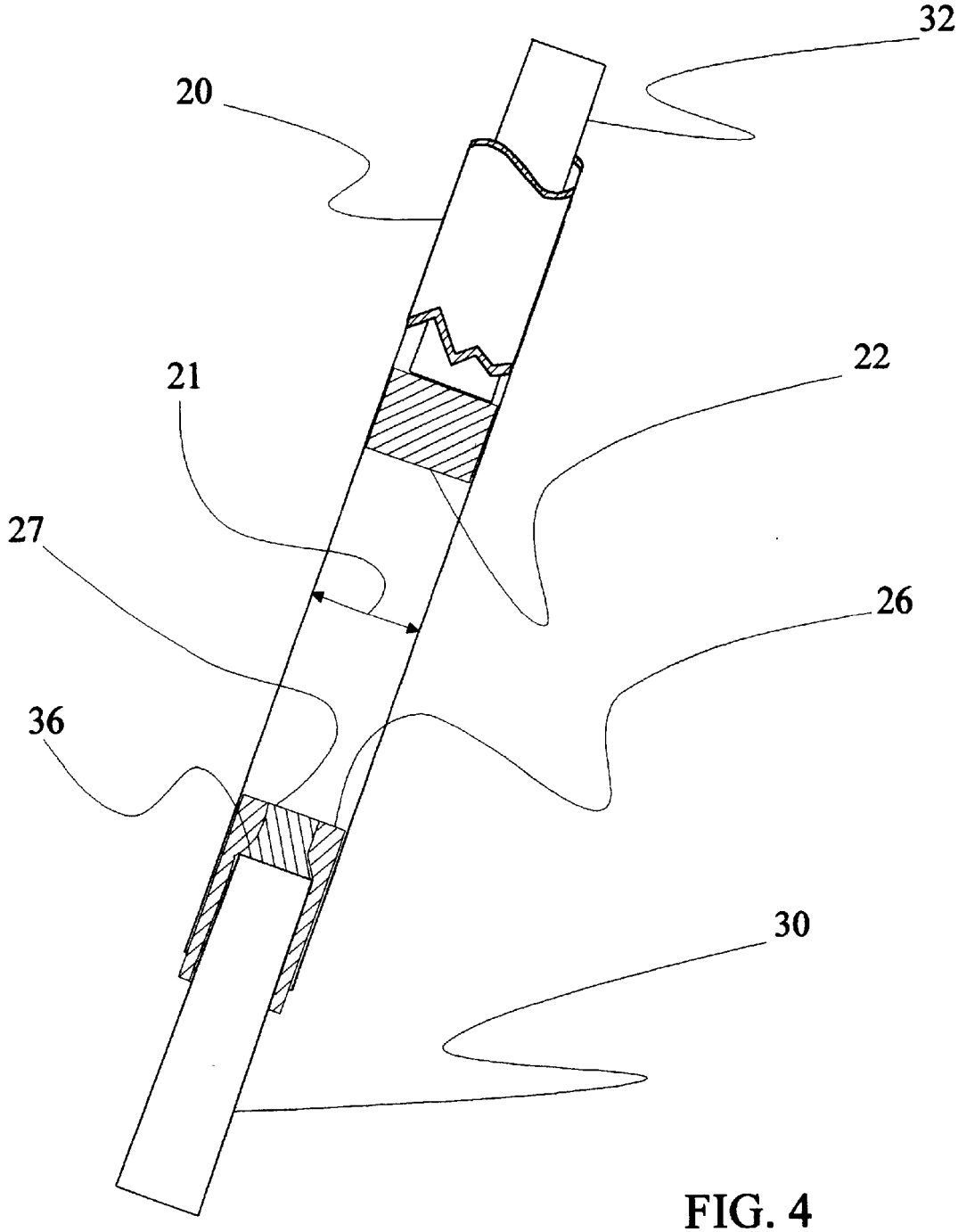
FIG. 4 shows a partial section view of the lower end of the invention.

In a preferred embodiment as illustrated in FIGS. 2 and 4 the holder has a spacer 22 for supporting extra pieces of chalk 32 in a storage area or storage compartment 34 and a removable closure 24 at the handle or upper end of said holder.

The chalk holding device 10 is designed for use on ground level surfaces by a human from a generally upright position. References to ground level surfaces in this document are meant to convey any surface upon which a human may stand, and may include floors and/or elevated surfaces. The tube 20 generally has a length greater than one foot but can be made to different lengths to better suit people of varied age and height. Typically, the tube 20 has an internal diameter or bore 21 approximately 1 to 1.5 inches for receiving a grip and pieces of chalk or other writing implement. In an ideal embodiment as illustrated in FIGS. 1 and 2 the holder comprises a straight tube 20, approximately 2 to 5 feet in length. Specialized demands may be met with lengths outside the optimum range cited in the ideal embodiment. The tube is a rigid material such as polyvinyl chloride or other plastic, cardboard, metal, wood, etc.

Figure 5A:
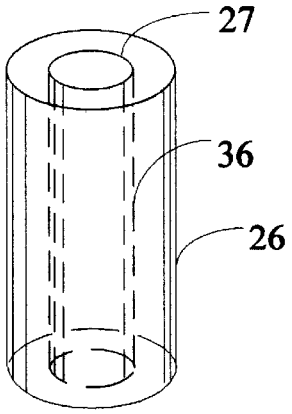
FIGS. 5A to 5E show enlarged views of varied embodiments of the grip.
Figure 5B:
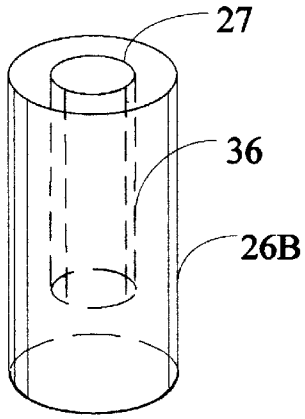
Figure 5C:
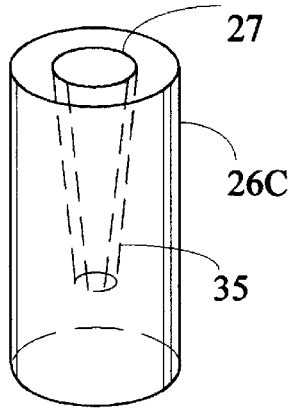
Figure 5D:
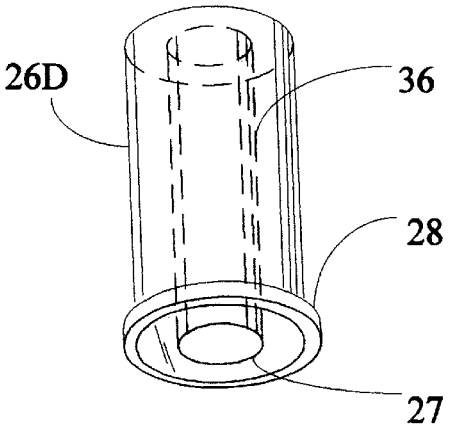
Figure 5E:
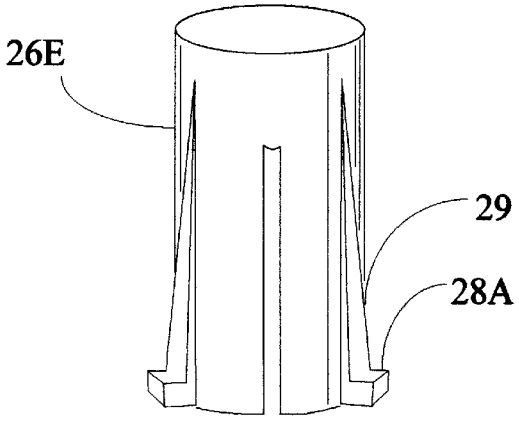

As illustrated in FIGS. 4 and 5A, in a preferred embodiment, the grip in the lower end of tube 20 has an aperture 27 for receiving and holding a stick of chalk or other writing implement. The grip comprises an inexpensive, resiliently compressible material such as polyethylene or polyurethane foam of semi-rigid density, which can be repeatedly compressed and continues to hold chalk by exerting pressure from an inside wall 36 resisting the compression as illustrated in FIG. 4. However the grip can consist of any other material that can be flexed such as rubber, cardboard, leather, paper, metal, etc.

The grip 26 as illustrated in FIGS. 4 and 5A comprises an overall length of approximately 2.5 inches in the preferred embodiment. Before insertion into tube 20 the grip 26 has an outside diameter approximately matching or slightly larger than the inside diameter of tube 20. Thus the grip is held in position within tube 20 by pressure and is easily removable by hand or by inserting a rod shaped object such as a common broom handle through opposite end of tube 20 to dislodge the grip.

In a preferred embodiment, holder 10 has a spacer 22 located within tube 20. The spacer may be composed of flexible material similar to those listed above for grip 26 and is held in position within tube 20 by pressure. A rod shaped object such as a common broom handle may be temporarily inserted through either end of tub 20 to position spacer to desired location. The location of the spacer is designed to be varied to allow a quick and easy change in size of storage compartment 34 for extra pieces of chalk 32.

FIGS. 5B–5E—Additional Embodiments

Other embodiments of the grip are shown in FIGS. 5B to 5E. One embodiment of the grip 26B has a shaft that extends through part of the longitudinal axis of the grip. Another embodiment of the grip 26C has a tapered shaft that extends through part of the longitudinal axis of the grip. An embodiment of grip 26D has a collet 28 that resists slippage into the shaft of tube 20. Yet another embodiment of grip 26E has multiple tapered flanges 29 along the outside wall which increasingly pinches the writing chalk as said grip is inserted into tube 20. Flanges 29 end with tab 28A that resists slippage into the shaft of tube 20.

Operation—FIG. 1

In use, a human holds the holder 10 by gripping with either or both hands at any comfortable position along the length of the tube 20. It is further contemplated that the user may grasp the tube 20 with one hand allowing the upper end of the tube 20 to rest against the body of the user for support while using by walking about the drawing surface. Chalk is simply and easily inserted into grip 26 for use by pushing tapered end of chalk stick into the grip. The user is afforded access to chalk or other marking implements of same or additional color choices to the implement in current use by means of the storage compartment 34.

Conclusion, Ramifications, and Scope

Accordingly, the reader will see that the chalk holding device of this invention can be used by children and adults of almost any age to comfortably reach surfaces that otherwise require straining, bending or squatting to make marks with large pieces of chalk known as sidewalk chalk. The user is therefore able to conveniently apply markings to a vary large surface while walking, ruining, skating, etc. Therefore, large scale markings such as a quick layout of boundaries for hard court basketball, street hockey and other recreational activities is easily accomplished with this invention In addition, the chalk holder has a readily accessible storage compartment for extra pieces of chalk. Furthermore, the chalk holder has the additional advantages in that It permits the user to reach less accessible surfaces such as a high ceiling or other elevated object.

It permits use of a variety of marking implements such as sidewalk or large pieces of chalk, ink or pigmented markers, crayons, and the like.

The length of the reach is varied by the user simply by grasping the chalk holder at any position along the longitudinal axis of the tube.

The grip 26 allows easy exchange of sidewalk chalk or other writing material in a simple manner that is intuitive to even a small child.

As to a further discussion of the manner of usage and operation of the present invention, the same should be apparent from the above description. Accordingly, no further discussion related to the manner of usage and operation will be provided.

With respect to the above description therein, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention Further, since numerous modification and changes will readily occur to those skilled in the art, it is not desired to limit the invention to the exact construction and operation shown and described, and accordingly, all suitable modifications and equivalents may be resorted to, falling within the scope of the invention.

I claim:

1. A device for holding a stick of chalk and having a tube of a predetermined length whereby the human user may grasp said device with one or both hands while marking a sidewalk, driveway, street or other ground-level surface generally perpendicular to the user while standing, walking, running, or skating, said device comprising:

a generally straight, elongated tube having upper and lower ends of rigid construction and having substantial length whereby the user's reach is significantly increased for marking said ground-level surface from a generally upright position, while holding said upper end of said tube; and the tube having a longitudinal axis through said upper and lower ends coaxial with a longitudinal axis of said stick of chalk;

said device having attachment means for attaching the stick of chalk to said lower end of the tube in linear arrangement with said upper and lower ends of the tube;

said attachment means comprising a cylinder of resiliently compressible material mounted within said tube such that a portion thereof extends outwardly of said lower end.

2. The device of claim 1, wherein said tube has a diameter greater than about 0.75 inches for receiving sidewalk chalk.

3. The device of claim 1, wherein said tube has a length greater than about two feet.

4. The device of claim 1, wherein said attachment means is slidably and removably inserted into said lower end of said tube, whereby chalk pieces may be easily exchanged by removing the attachment means along with said chalk pieces.

5. The device of claim 1, further comprising a spacer within said tube for supporting a plurality of extra pieces of chalk.

6. The device of claim 1, further comprising a closure at the upper end of said tube.

7. A handheld device for marking a driveway, sidewalk, street, or other ground-level surface, said device comprising:

an elongated tube of rigid construction having opposed marking and handle end portions;

a removably insertable resiliently compressible cylindrical shaped grip having a portion thereof extending outwardly from said marking end portion for receiving and attaching a stick of writing material to the marking end portion, said tube having a longitudinal axis through said end portions coaxial with a longitudinal axis of said stick of writing material; whereby the writing material is held in linear arrangement with the marking and handle end portions of the tube;

whereby the user may grasp the handle with one or both hands and whereby the user may make markings on said ground-level surface from a generally upright position while standing, walking, running, or skating.

8. The device of claim 7, wherein said grip comprises a resiliently compressible material and having a diameter greater than about 0.75 inches whereby the grip is capable of receiving sidewalk chalk or other large marking material and the grip is slidably engaged with the marking end portion of the tube whereby the grip and unused portion of said sidewalk chalk can be easily removed together.

9. The device of claim 7, wherein said handle end portion has a bore for receiving a plurality of pieces of marking material, said device further including a spacer and a removable closure for retaining said pieces of marking material in storage within the device for future use.

10. An elongated device for marking sidewalks, driveways and streets, said device comprising:

a straight tube member having upper and lower end portions;

a removably insertable, resiliently compressible hollow cylindrical grip for attaching sidewalk chalk to said lower end portion in a linear relationship with the straight tube member, a portion of said grip extending outwardly from said lower end portion;

whereby the user can make markings on a ground-level surface from a generally upright position.

11. The device of claim 10 further including a storage compartment comprising a spacer and a removable closure for retaining a plurality of extra pieces of marking material not in use.

12. The device of claim 10, wherein said hollow grip means comprises a cylinder of resiliently compressible material.

* * * * *